US008360166B2

(12) United States Patent
Iimura et al.

(10) Patent No.: US 8,360,166 B2
(45) Date of Patent: Jan. 29, 2013

(54) ROTARY STRIKING TOOL

(75) Inventors: Yoshio Iimura, Ibaraki (JP); Kenro Ishimaru, Ibaraki (JP); Kazutaka Iwata, Ibaraki (JP); Nobuhiro Takano, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 148 days.

(21) Appl. No.: 12/877,258

(22) Filed: Sep. 8, 2010

(65) Prior Publication Data

US 2011/0079407 A1 Apr. 7, 2011

(30) Foreign Application Priority Data

Oct. 1, 2009 (JP) ..... P2009-230037

(51) Int. Cl.
*B25B 23/14* (2006.01)

(52) U.S. Cl. ..... 173/1; 173/2; 173/93.5; 173/176; 173/183

(58) Field of Classification Search ..... 173/2, 181, 173/183, 176, 4, 178, 180, 217, 93, 93.5, 173/1

See application file for complete search history.

(56) References Cited

U.S. PATENT DOCUMENTS 5,366,026 A * 11/1994 Maruyama et al. ..... 173/180
6,311,786 B1 * 11/2001 Giardino et al. ..... 173/1
6,371,218 B1 * 4/2002 Amano et al. ..... 173/183
6,598,684 B2 * 7/2003 Watanabe ..... 173/2
6,607,041 B2 * 8/2003 Suzuki et al. ..... 173/4
6,687,567 B2 * 2/2004 Watanabe ..... 700/168
6,892,826 B2 * 5/2005 Giardino ..... 173/1
6,968,908 B2 * 11/2005 Tokunaga et al. ..... 173/181
7,086,483 B2 * 8/2006 Arimura et al. ..... 173/217
7,419,013 B2 * 9/2008 Sainomoto et al. ..... 173/181
7,958,944 B2 * 6/2011 Lehnert et al. ..... 173/1

FOREIGN PATENT DOCUMENTS

JP 2005-305578 11/2005
JP 2008-213089 A 9/2008

OTHER PUBLICATIONS

Extended European Search Report issued in European Patent Application No. 10009288.1, dated Jan. 20, 2012.

* cited by examiner

*Primary Examiner* — Scott A. Smith
(74) *Attorney, Agent, or Firm* — McDermott Will & Emery LLP

(57) ABSTRACT

According to an aspect of the present invention, there is provided a rotary striking tool, including: a motor; an impact unit having a driving part being driven by the motor and an output part; a tip-tool side output shaft that is coupled to the output part; an impact detection unit that detects an impact generated at the impact unit; and a control unit programmed to: control the impact unit to perform a confirmation striking when the impact detected by the impact detection unit reaches a prescribed value, detect a rotation angle of the output shaft at the confirmation striking, determine whether a fastening operation is completed when the detected rotation angle is equal to or smaller than a predetermined angle, and continue the fastening operation when the detected rotation angle is larger than the predetermined angle.

10 Claims, 11 Drawing Sheets

ROTARY STRIKING TOOL

CROSS-REFERENCE TO RELATED APPLICATION(S)

This application is based upon and claims priority from Japanese Patent Application No. 2009-230037 filed on Oct. 1, 2009, the entire contents of which are incorporated herein by reference.

BACKGROUND

1. Field of the Invention

An aspect of the present invention relates to a rotary striking tool which is driven and rotated by a motor to thereby fasten a fastening member such as a screw or a bolt by using an intermittent striking force.

2. Description of the Related Art

As a rotary striking tool (driving tool), an impact tool which fastens a screw or a bolt etc. by applying a rotation force or a rotational-direction striking force is known. JP-2005-305578-A discloses an impact driver as the kinds of the rotary striking tool. Further, there is known an oil pulse tool using an oil pulse unit as a striking mechanism. In the impact driver disclosed in JP-2005-305578-A, a hummer part rotates while being axially-movable by using a spring or a cam mechanism, and a hammer strikes an anvil once or twice with respect to a single rotation of the anvil.

The oil pulse tool has a feature that the level of the operation sound is low since metal parts never contact to each other. In the oil pulse tool, a motor is used as a power source for driving an oil pulse unit, and the rotation shaft of the motor is directly coupled to the oil pulse unit. When a trigger switch for operating the oil pulse tool is pulled, a driving electric power is supplied to the motor. The rotation speed of the motor is controlled by changing the driving force of the motor in response to the pulling amount of the trigger switch. When the oil pulse unit generates a pulse torque, a strong striking torque is transmitted to a tip tool, whereby a torque sensor detects the peak torque of the output shaft at every striking operation. An angular sensor is provided at the output shaft to detect the rotation angle of the output shaft, whereby the peak torque value is controlled to approach a target torque value in accordance with a difference between the previously-set target curve of the peak torque values from the fastening start timing to the fastening completion timing and the measured peak torque value.

In the sold oil pulse tool, an increasing amount of the rotation angle at each striking is calculated based on an angle value obtained from an angular sensor. When the increasing amount of the rotation angle is larger than a reference value (seating state determination value), it is determined that the fastening operation is not completed yet to thereby continue the striking operation even if a peak torque exceeds a reference value (fastening operation completion determination value). The motor is stopped when two conditions are satisfied that the peak value exceeds the fastening operation completion determination value and the increasing amount of the rotation angle is smaller than the seating state determination value. In order to surely control the fastening operation completion state based on the two conditions of the peak torque and the increasing amount of the rotation angle, it is necessary to provide a torque sensor and an angular sensor at the output shaft of the oil pulse tool, so that a rotary transformer is required in order to transmit and receive signals to and from these sensors. As a result, the impact tool is enlarged to provide the angular sensor and the rotary transformer etc., whereby electric wiring becomes complicated and the tool becomes expensive.

SUMMARY

One object of the invention is to provide a rotary striking tool which can accurately detect the rotation angle of an output shaft at the striking operation even if an angular sensor is not provided at the output shaft.

Another object of the invention is to provide the rotary striking tool which can surely perform the fastening operation up to a prescribed torque even if the angular sensor or a torque sensor is not provided at the output shaft.

A still another object of the invention is to provide the rotary striking tool unit in which a completion of a fastening operation is confirmed by the output of an impact sensor and the rotation angle of a motor to thereby avoid the fastening failure of the fastening member.

According to an aspect of the present invention, there is provided a rotary striking tool, including: a motor; an impact unit having a driving part and an output part, the driving part of the impact unit being driven by the motor; an output shaft that is coupled to the output part of the impact unit such that a tip tool can be attached to the output shaft; an impact detection unit that detects an impact generated at the impact unit; and a control unit programmed: to control the impact unit to perform a confirmation striking when the impact detected by the impact detection unit reaches a prescribed value, detect a rotation angle of the output shaft at the confirmation striking, determine whether a fastening operation is completed when the detected rotation angle is equal to or smaller than a predetermined angle, and continue the fastening operation when the detected rotation angle is larger than the predetermined angle.

A rotation of the motor may be controlled so that a force of the confirmation striking is smaller than a force of a previous striking performed prior to the confirmation striking.

According to the above configuration, when it is determined that the output value detected by the impact detection unit reaches the prescribed value, the impact unit performs the confirmation striking and detects the rotation angle of the output shaft through the confirmation striking. When the detected rotation angle is equal to or smaller than the predetermined angle, since the fastening operation is completed, a fastening insufficient state can be effectively prevented from being caused. In contrast, when the detected rotation angle is larger than the predetermined angle, since the fastening operation is continued, the fastening operation can be completed surely.

When the rotation of the motor is controlled so that the force of the confirmation striking is smaller than the force of the previous striking, a fastening member can be prevented from being excessively fastened in the confirmation striking.

The motor may be a brushless DC motor. Rotation position detection elements may be provided at the brushless DC motor. And, the rotation angle may be calculated based on outputs of the rotation position detection elements.

The rotation angle may be calculated based on variation in the outputs of the rotation position detection elements during a period from a previous striking to a next striking.

The brushless DC motor may include a rotor having plural permanent magnets of pairs of N and S poles. And, the position detection elements may be hall elements or hall ICs which are provided at a predetermined interval so as to face the permanent magnets.

The confirmation striking may be performed in a state where a duty ratio of a signal supplied to an inverter circuit for supplying a driving current to the brushless DC motor is reduced.

According to the above configuration, the brushless DC motor is used as the motor, and the rotation angle of the output shaft is indirectly (not directly) detected/calculated by using the outputs of the rotation position detection elements provided at the brushless DC motor. Since it is not necessary to provide a sensor for directly detecting the rotation angle at the output shaft to which the tip tool is attached, the size of the rotary striking tool can be made small and the manufacturing cost thereof can be reduced.

Since the rotation angle is calculated based on the position detection pulses appearing from the previous striking to the next striking, it is possible to calculate how much the output shaft rotated at the previous striking.

The position detection elements are configured by the hall elements or the hall ICs which are disposed with a predetermined interval so as to oppose to the permanent magnets. The operation of the invention can be realized only by appropriately controlling the calculation part without changing the configuration of the existing motor.

The confirmation striking is performed in a state that the duty ratio of the signal supplied to the inverter circuit for supplying the driving current to the brushless DC motor is reduced. Thus, the fastening member is prevented from being excessively fastened in the confirmation striking.

According to another aspect of the present invention, there is provided a power tool including: a motor; a tip tool coupled to the motor; a rotation detection unit that detects rotation of the motor; and a control unit programmed to detect a driving position of the tip tool based on an output from the rotation detection unit.

Since the driving position of the tip tool can be detected by the rotation detection unit, it is not necessary to provide other detection unit capable of detecting the driving position of the tip tool. Thus, since it is not necessary to provide an additional detection unit, a cheep power tool can be provided. Since the driving position of the tip tool is detected, the tip tool can be appropriately controlled.

The aforesaid and other objects and new features of the invention will be apparent from the following description of the specification and accompanying drawings.

DETAILED DESCRIPTION

Embodiment 1

Figure 1:
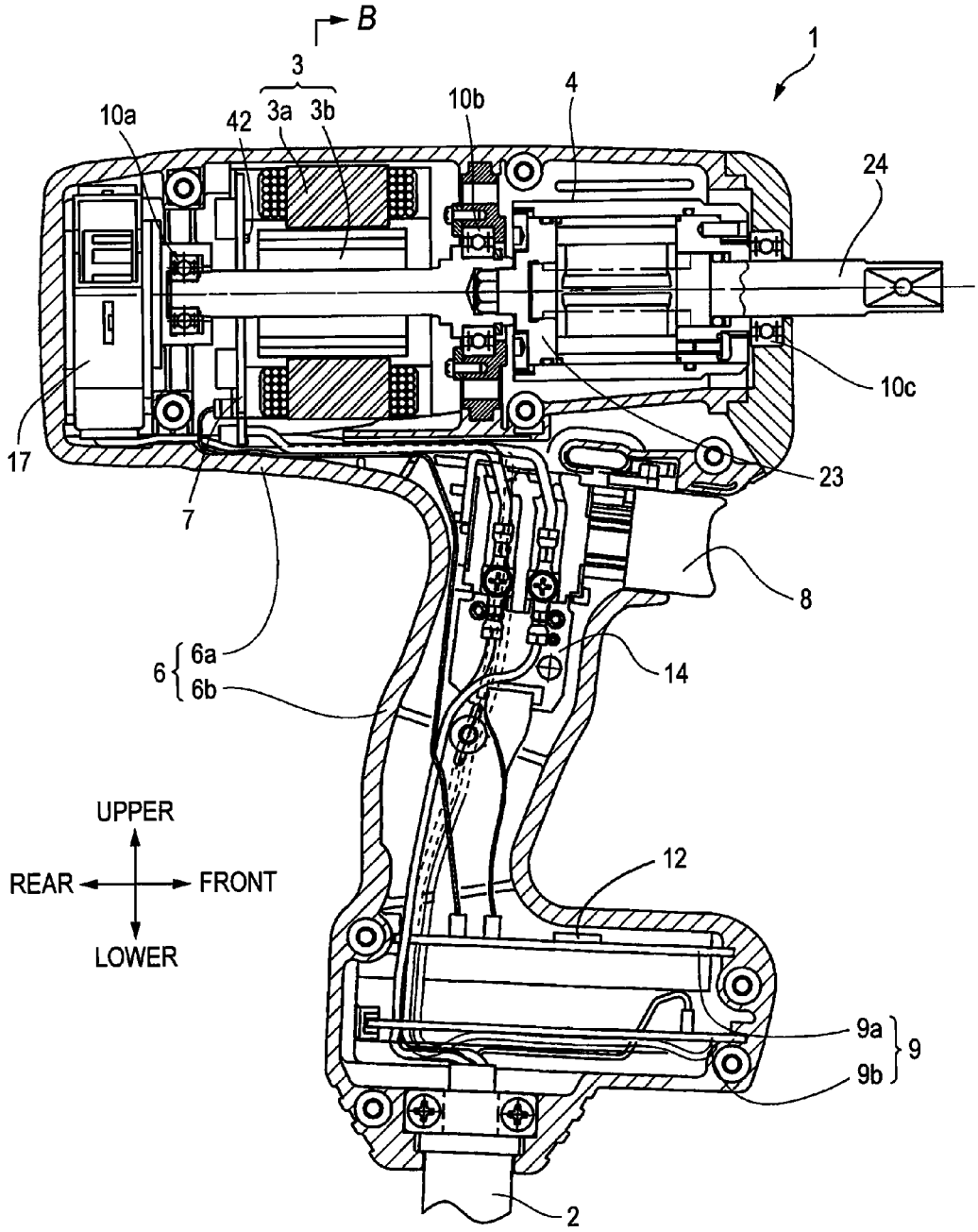
FIG. 1 is a sectional diagram of an impact driver according to an embodiment.

Hereinafter, the embodiment will be explained with reference to drawings. In this embodiment, an impact driver using an oil pulse unit is exemplified as a rotary striking tool. FIG. 1 shows the impact driver according to the embodiment. In the specification, directions of upper, lower, forward and rear will be explained as being coincident with the directions of upper, lower, forward and rear shown in FIG. 1, respectively.

The impact driver 1 performs a fastening procedure for fastening a screw, a nut, a bolt etc. In the fastening procedure, a motor 3 is driven by electric power supplied via a power supply cable 2 from the outside, and then the motor 3 drives an oil pulse unit 4 to apply a rotation force and an impact force to the main shaft of the oil pulse unit 4 to thereby continuously/intermittently transmit a rotation striking force to a not-shown tip tool such as a driver bit, a hexagonal socket etc.

The electric power supplied to the power supply cable 2 is a DC or an AC of 100 volt, for example. In the case of AC, a not-shown rectifier is provided within the impact driver 1 to convert the AC into the DC and to supply the converted DC to the driving circuit for the motor. The motor 3 is a brushless DC motor which includes a rotor 3*b* having permanent magnets on the inner periphery side thereof and a stator 3*a* having a winding wound around an iron core on the outer periphery side thereof. A housing 6 includes a body part 6*a* and a handle part 6*b* integrally formed with each other. The motor is housed within the cylindrical body part 6*a* so that the rotation shaft thereof is rotatably fixed by two bearings 10*a*, 10*b*. The housing 6 is formed of plastics etc. A driving circuit board 7 for driving the motor 3 is disposed on the rear side of the motor 3. An inverter circuit configured by semiconductor elements such as FETs and rotation position detection elements 42 such as hall elements or hall ICs for detecting the rotation positions of the rotary 3*b* are disposed on this circuit board. A cooling fan unit 17 for cooling is provided on the rearmost side of the body part 6*a*.

In the housing 6, the handle part 6*b* extends beneath from the body part 6*a* about orthogonally with respect to the longitudinal direction of the body part 6*a*. A trigger switch 8 is disposed around a portion where the handle part 6*b* is attached to the body part 6*a*. A switch circuit board 14 provided beneath the trigger switch transmits a signal corresponding to the pulling amount of the trigger switch 8 to a motor control board 9*a*. Two control boards 9, that is, the motor control board 9*a* and a rotation position detection board 9*b*, are provided on the lower side of the handle part 6*b*. The motor control board 9*a* is provided with an impact sensor 12 for detecting a striking impact at the oil pulse unit 4. The striking impact can be detected from the output of the impact sensor 12. Instead of providing the impact sensor 12 as an impact detection unit, the striking impact at the oil pulse unit 4 may be detected based on a current flowing through the motor. In this case, the unit that detects the current flowing through the motor may be functioning as the impact detection unit.

The oil pulse unit 4 is housed within the body part 6*a* of the housing 6. In the oil pulse unit 4, a liner plate 23 on the rear side and the main shaft 24 on the front side are provided. The liner plate 23 is directly coupled to the rotation shaft of the motor 3, and the main shaft 24 acts as the output shaft of the impact driver 1. When the trigger switch 8 is pulled to thereby start the motor 3, the rotation force of the motor 3 is transmitted to the oil pulse unit 4. Oil is filled within the oil pulse unit 4. When no load is applied to the main shaft 24 or an applied load is small, the main shaft 24 rotates almost synchronizedly with the rotation of the motor 3 only against the drag of the oil. When a large load is applied to the main shaft 24, the main shaft 24 stops the rotation, while an outer-peripheral liner 21 fixed to the liner plate 23 continues to rotate. The oil pulse unit 4 generates a spiry strong torque and thereby transmits a large fastening torque to the main shaft 24 at a position where the oil is sealed at every one revolution. Hereinafter, similar striking operations are repeated for several times to thereby fasten a fastening subject with a set torque. The main shaft 24 is rotatably supported by the body part 6*a* of the housing 6 through a bearing 10*c*. Although a ball bearing is exemplified as the bearing 10*c* in this embodiment, another bearing such as a needle bearing may be used in place thereof.

Figure 2:
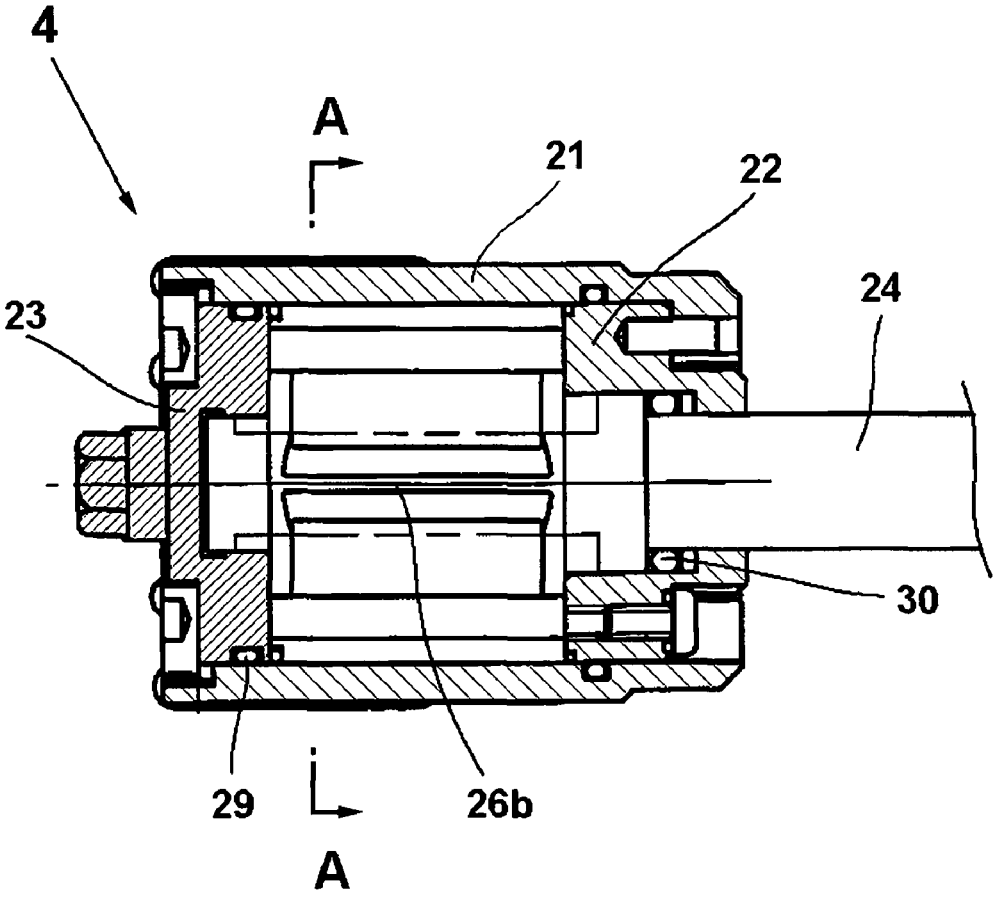
FIG. 2 is an enlarged sectional diagram of an oil pulse unit 4 in the impact driver shown in FIG. 1.

FIG. 2 is an enlarged sectional diagram of the oil pulse unit 4 of the impact driver shown in FIG. 1. The oil pulse unit 4 is mainly configured by two portions, that is, a driving part rotating synchronizedly with the motor 3 and an output part rotating synchronizedly with the main shaft 24 attached with the tip tool. The driving part includes the liner plate 23 directly coupled to the rotation shaft of the motor 3, a liner 21 having a cylinder-like outer periphery fixed to the liner plate 23 and a lower plate 22. One end of the liner 21 is fixed to the outer periphery of the liner plate 23, and the other end forwardly extends. The output part includes the main shaft 24 and blades 25*a*, 25*b*. On the outer circumferential side of the main shaft 24, grooves are formed 24 with the interval of 180 degrees. The blades 25*a*, 25*b* are attached to the grooves on the main shaft 24 via springs, respectively.

The main shaft 24 is inserted into the lower plate 22 and held within a closed space defined by the liner 21, the liner plate 23 and the lower plate 22 so as to be rotatable therein. Oil (operation oil) for generating the torque is filled within the closed space. An O-ring 30 is provided between the lower plate 22 and the main shaft 24, and also an O-ring 29 is provided between the liner 21 and the liner plate 23, thereby securing the sealability. Although not shown, the liner 21 is provided with a relief valve for flowing the oil form the high-pressure side to the low-pressure side, so that the oil pressure (fastening torque) is adjusted.

Figure 3:
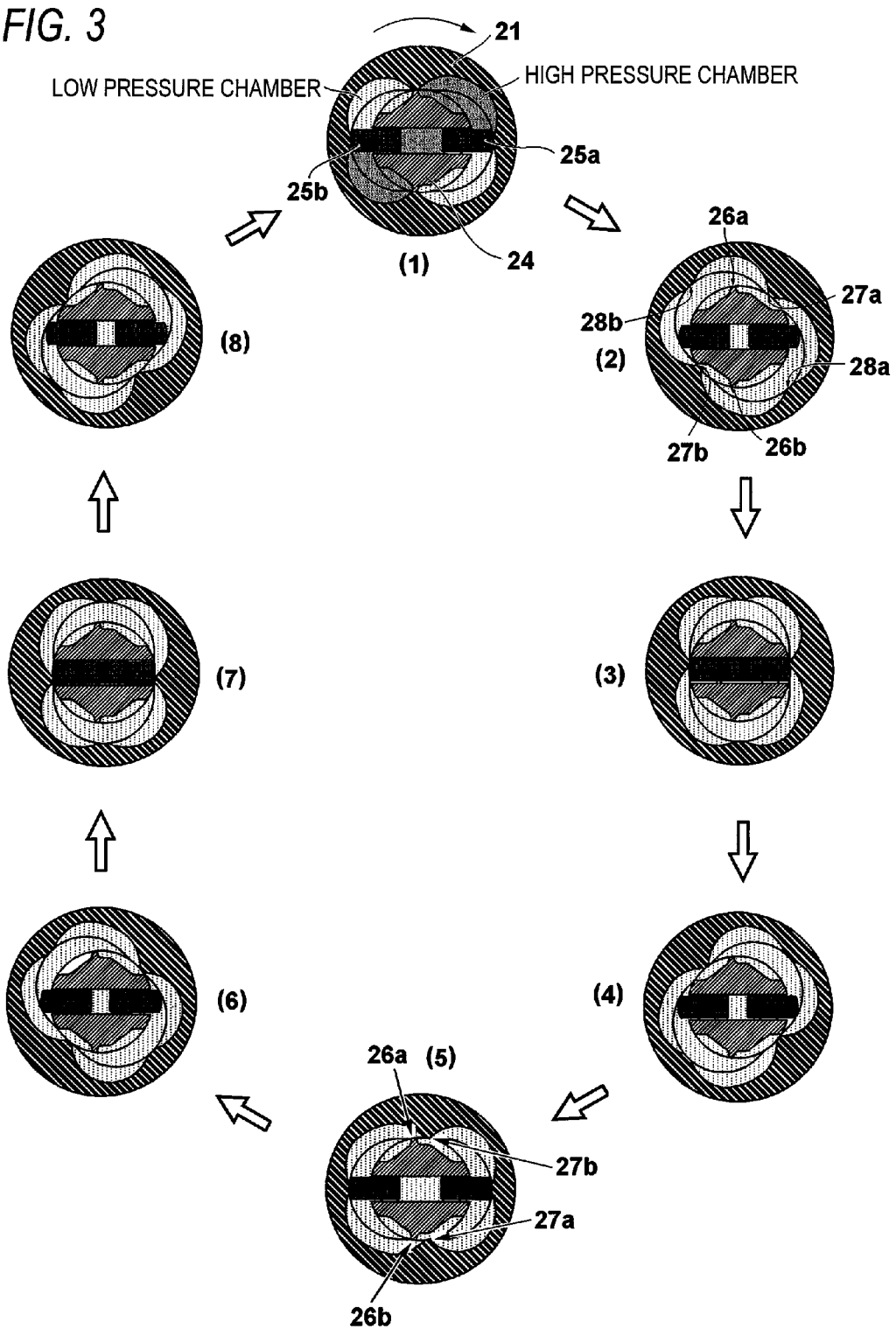
FIG. 3 is sectional diagram taken along a line A-A in FIG. 2 showing the one revolution motion of the oil pulse unit 4 in eight steps.

FIG. 3 is a sectional diagram taken along a line A-A in FIG. 2 showing the one revolution motion of the oil pulse unit 4 in eight steps. Within the liner 21, a liner chamber having four areas is formed as shown in (1) of FIG. 3. The blades 25*a*, 25*b* are respectively fitted via the springs into the opposed two grooves formed on the outer circumferential side of the main shaft 24, whereby the blades 25*a*, 25*b* are radially urged to abut against the inner surface of the liner 21. Two protruded seal surfaces 26*a*, 26*b* extending to the axis direction are provided on the outer peripheral surface of the main shaft 24 between the blades 25*a*, 25*b*. Protruded seal surfaces 27*a*, 27*b* and protruded parts 28*a*, 28*b* are formed on the inner peripheral surface of the liner 21 so as to have a mountain-like shape, respectively.

In the fastening operation of a bolt by using the impact driver 1, when the seat surface of the fastening-subject bolt is seated, a load is applied to the main shaft 24, whereby the main shaft 24 and the blades 25*a*, 25*b* are almost stopped and only the liner 21 continues to rotate. Since the liner 21 rotates with respect to the main shaft 24, an impact pulse is generated at each revolution of the liner. When the impact pulse is generated within the impact driver 1, the protruded seal surface 27*a* formed on the inner peripheral surface of the liner 21 is made contact with the protruded seal surface 26*a* formed on the outer peripheral surface of the main shaft 24. Simultaneously, the protruded seal surface 27*b* contacts with the protruded seal surface 26*b*. In this manner, since a pair of the protruded seal surfaces 27*a*, 27*b* abut against a pair of the protruded seal surfaces 26*a*, 26*b*, respectively, the inner space of the liner 21 is divided into two high-pressure chambers and two low-pressure chambers. An instantaneous strong rotation force is generated at the main shaft 24 due to a pressure difference between the high-pressure chamber and the low-pressure chamber.

Next, the operation procedure of the oil pulse unit 4 will be explained. (1) to (8) of FIG. 3 show states where the liner 21 rotates by one revolution relatively with respect to the main shaft 24. When the trigger switch 8 is pulled, the motor 3 rotates and so the liner rotates synchronizedly with the motor. In this embodiment, the liner plate 23 is directly coupled to the rotation shaft of the motor 3 to rotate in the same speed therewith. However, the liner plate 23 may be coupled to the motor 3 via a speed reduction mechanism or a deceleration mechanism. When no load is applied to the main shaft 24 or an applied load is small, the main shaft 24 rotates almost synchronizedly with the rotation of the motor 3 only against the drag of the oil. When a large load is applied to the tip tool, the central main shaft 24 stops the rotation and only the outer-peripheral liner 21 continues to rotate. FIG. 3 shows the states where only the liner 21 rotates.

(1) of FIG. 3 shows the position in which a striking force is generated at the main shaft 24 due to the impact pulse. The position shown in (1) represents a "position for hermetically sealing the oil" appearing once during one revolution. In this case, the protruded seal surfaces 27*a*, 27*b* respectively abut against the protruded seal surfaces 26*a*, 26*b*, and the blades 25*a*, 25*b* respectively abut against the protruded parts 28*a*, 28*b* on the entire axial range of the main shaft 24, whereby the inner space of the liner 21 is partitioned into four chambers, that is, the two high-pressure chambers and the two low-pressure chambers.

The "high-pressure" and the "low-pressure" represent the pressure of the oil within the inner space. When the liner 21 rotates in accordance with the rotation of the motor 3, since the capacity of the high-pressure chamber reduces, the oil therein is compressed to thereby instantaneously generate a high pressure and push the blade 25 to the low-pressure chamber side. As a result, a rotation force instantaneously acts on the main shaft 24 via the blades 25*a*, 25*b* to thereby generate a strong rotation torque. That is, a strong striking force is generated by the high-pressure chambers to rotate the blades 25*a*, 25*b* in the clockwise direction shown in the figure. The position shown in (1) of FIG. 3 is called a "striking position" in this specification (2) of FIG. 3 shows a state where the liner 21 rotates by 45 degrees from the striking position. When the liner 21 passes the striking position shown in (1), since the abutment between the protruded seal surface 27*a*, 27*b* and the protruded seal surfaces 26*a*, 26*b* and the abutment between the blades 25*a*, 25*b* and the protruded parts 28*a*, 28*b* are cancelled, the space within the liner 21 divided into the four chambers is released.

Thus, since the oil flows into the respective chambers, the rotation torque is not generated and the liner 21 further rotates due to the rotation of the motor 3.

(3) of FIG. 3 shows a state where the liner 21 rotates by 90 degrees from the striking position. In this state, the blades 25*a*, 25*b* are radially retreated by being abutted against the protruded seal surfaces 27*a*, 27*b* to positions not protruding from the main shaft 24, respectively. Thus, since there is no influence of the oil pressure and the rotation torque is not generated, the liner 21 continues to rotate.

(4) of FIG. 3 shows a state where the liner 21 rotates by 135 degrees from the striking position. In this state, since the respective areas in the liner 21 are communicated to each other, no pressure difference is caused there among, so that no rotation torque is generated at the main shaft 24.

(5) of FIG. 3 shows a state where the liner 21 rotates by 180 degrees from the striking position. Here, the protruded seal surfaces 26*a* and 26*b* are asymmetrically (not symmetrically) disposed on the main shaft 24 with respect to the axis thereof. Therefore, in this position, the protruded seal surfaces 27*b*, 27*a* respectively approach the protruded seal surfaces 26*a*, 26*b* but do not abut thereagainst, respectively. Similarly, the protruded seal surfaces 27*a* and 27*b* are asymmetrically (not symmetrically) disposed on the inner periphery of the liner 21 with respect to the axis of the main shaft 24. Thus, in this position, since the main shaft is scarcely influenced by the oil, the rotation torque is also scarcely generated. Since the oil filled within the inner space has viscosity and a small high-pressure chamber is formed when the protruded seal surface 27*b* or 27*a* opposes to the protruded seal surface 26*a* or 26*b*, a small rotation torque is generated unlike the cases of (2) to (4) and (6) to (8). However this rotation torque is not effective for the fastening procedure.

The states of (6) to (8) of FIG. 3 are almost the same as (2) to (4), respectively, and the rotation torque is scarcely generated in these states. When the liner 21 further rotates from the state of (8), the liner 21 returns to the state of (1). Thus, the protruded seal surfaces 27*a*, 27*b*, respectively abut against the protruded seal surfaces 26*a*, 26*b*, and the blades 25*a*, 25*b* respectively abut against the protruded parts 28*a*, 28*b* on the entire axial range of the main shaft 24, whereby the inner space of the liner 21 is partitioned into the two high-pressure chambers and the two low-pressure chambers and hence a large rotation torque is generated at the main shaft 24.

Figure 4:
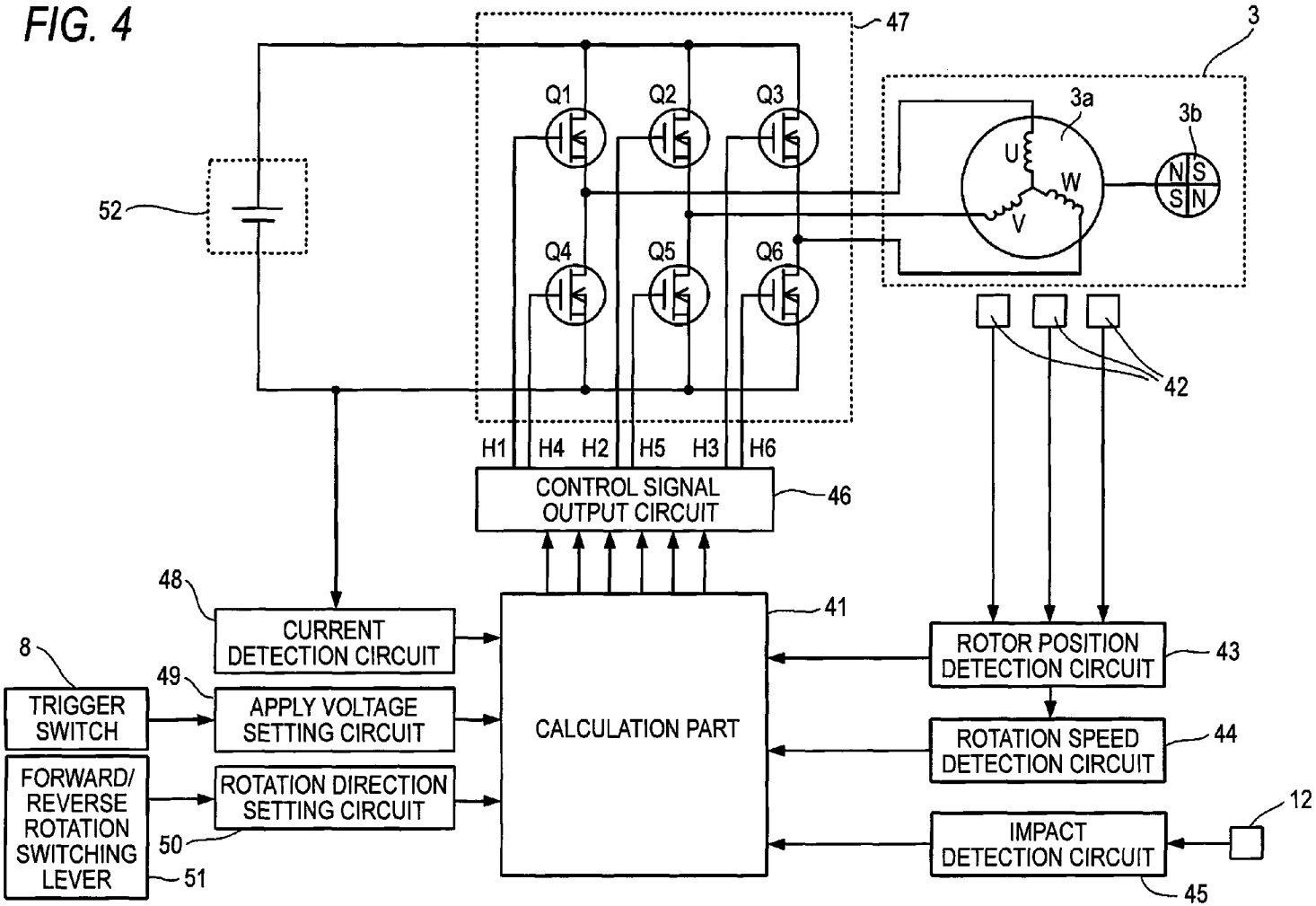
FIG. 4 shows a block configuration of the driving control system of a motor 3 according to the embodiment.

Next, the configuration and function of the driving control system of the motor 3 will be explained with reference to FIG. 4. FIG. 4 shows a block configuration of the driving control system of the motor 3. In this embodiment, the motor 3 is configured by a three-phase brushless DC motor. The brushless DC motor is an inner rotor type and includes a rotor 3*a* having the plural permanent magnets of pairs of N and S poles, a stator 3*b* having the three-phase stator windings U, V, W of the star-connection, and the three rotation position detection elements 42 disposed with the interval of a predetermined angle, for example, 60 degrees along the circumferential direction so as to detect the rotation position of the rotor 3*b*. The directions and the conduction times of the currents flowing into the stator windings U, V, W are controlled based on position detection signals from these rotation position detection elements 42.

The inverter circuit 47 includes six switching elements Q1 to Q6 such as FETs coupled in a three-phase bridge fashion. The gates of the six switching elements Q1 to Q6 coupled in the bridge fashion are coupled to a control signal output circuit 46. The drains or sources of the six switching elements Q1 to Q6 are coupled to the star-connected stator windings U, V, W. Thus, the six switching elements Q1 to Q6 perform the switching operation in accordance with switching element drive signals (drive signals H1 to H6) inputted from the control signal output circuit 46 to thereby convert the voltage applied from a DC power supply 52 to the inverter circuit 47 into voltages Vu, Vv, Vw of three-phases (U-phase, V-phase and W-phase) and apply these voltages to the stator windings U, V, W, respectively. The DC power supply 52 may be a detachable secondary battery.

Of the switching element drive signals (three-phase signals) for driving the respective gates of the six switching elements Q1 to Q6, the drive signals for the three switching elements Q4, Q5, Q6 on the negative power supply side are supplied as pulse width modulation signals (PWM signals) H4, H5, H6, respectively. A calculation part 41 (control unit) changes the pulse widths (duty ratios) of the PWM signals in accordance with the detection signal of an apply voltage setting circuit 49 based on the operation amount (stroke) of the trigger switch 8, to thereby adjust an amount of the power supplied to the motor 3 to control the start/stop and the rotation speed of the motor 3.

The PWM signals are supplied to the switching elements Q1 to Q3 on the positive power supply side of the inverter circuit 47 or the switching elements Q4 to Q6 on the negative power supply side to thereby switch the switching elements Q1 to Q3 or the switching elements Q4 to Q6 at a high speed to thereby control the power to be supplied to the stator windings U, V, W from the DC power supply. In this embodiment, the PWM signals are supplied to the switching elements Q4 to Q6 on the negative power supply side. Thus, when the pulse widths of the PWM signals are controlled, since the power supplied to the stator windings U, V, W are adjusted, the rotation speed of the motor 3 can be controlled.

The impact driver 1 is provided with a forward/reverse rotation switching lever 51 for switching the rotation direction of the motor 3. A rotation direction setting circuit 50 sends a control signal for switching the rotation direction of the motor 3 to the calculation part 41 (control unit) when the forward/reverse rotation switching lever 51 is changed. Although not shown, the calculation part 41 (control unit) includes a central processing unit (CPU) for outputting the drive signals based on a processing program and data, a ROM for storing the processing program and control data, a RAM for temporarily storing data, and a timer etc. A rotation speed detection circuit 44 receives a signal from a rotor position detection circuit 43 to detect the rotation speed of the motor 3, and outputs the detection value to the calculation part 41. The rotor position detection circuit 43 outputs a position signal representing the rotation position of the motor 3 based on the signals from the rotation position detection elements 42. An impact detection circuit 45 detects a striking impact caused by a striking operation in accordance with the signal from the impact sensor 12 and outputs the detection value to the calculation part 41.

The calculation part 41 (control unit) outputs the drive signals for alternately switching the predetermined switching elements Q1 to Q6 based on the output signals from the rotation direction setting circuit 50 and the rotor position detection circuit 43 and outputs the drive signals to the control signal output circuit 46. Thus, the current is alternately supplied to the predetermined windings of the stator windings U, V, W to thereby rotate the rotor 3*b* in the set rotation direction. In this case, the drive signals applied to the switching elements Q4 to Q6 on the negative power supply side of the inverter circuit 47 are outputted as the PWM modulation signals based on the output control signal from the apply voltage setting circuit 49. The current supplied to the motor 3 is measured by a current detection circuit 48 and the measured value is feedbacked to the calculation part 41, whereby the drive signals are adjusted so that the set drive power is applied to the motor. The PWM signals may be supplied to the switching elements Q1 to Q3 on the positive power supply side.

Figure 5:
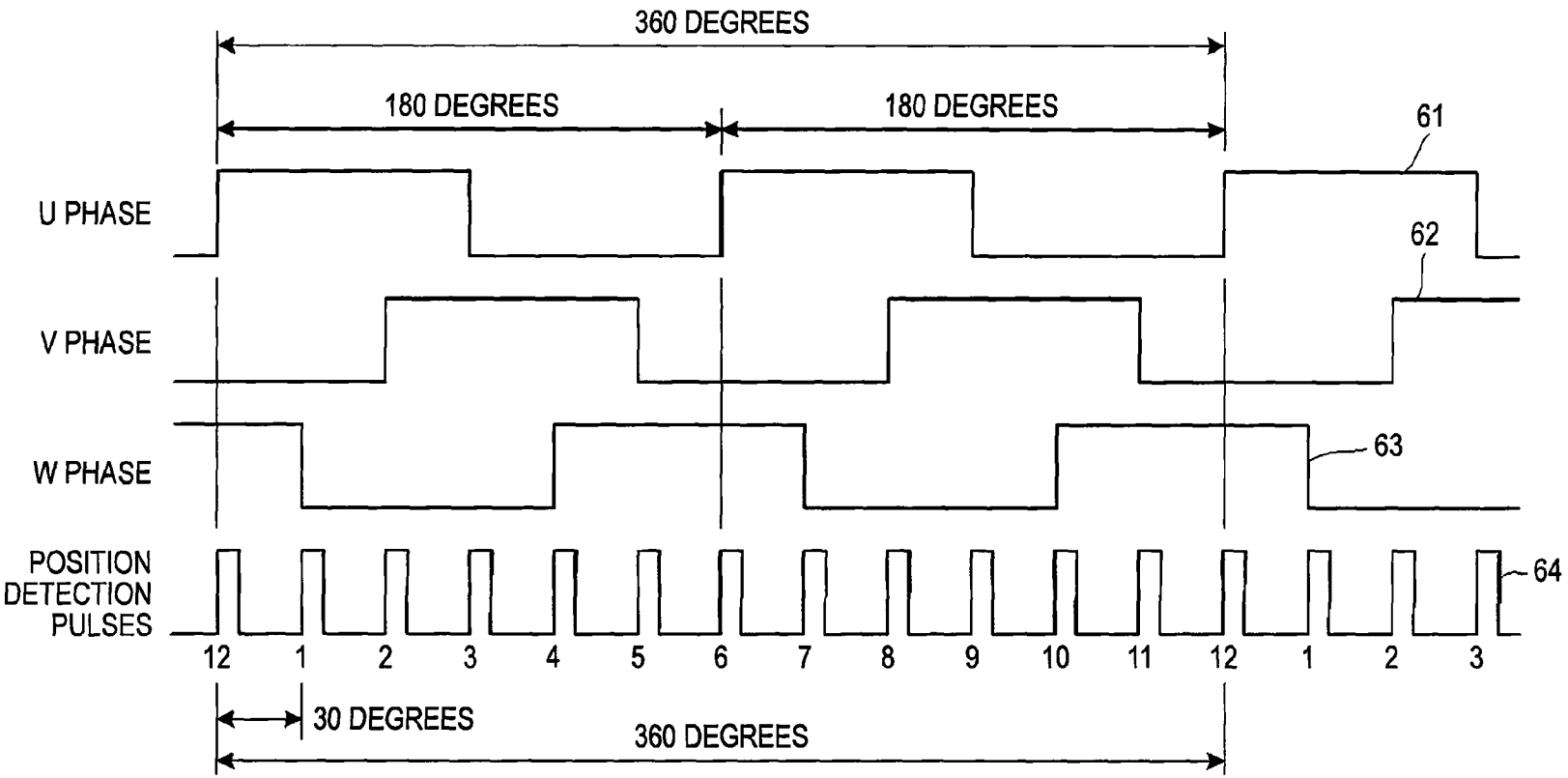
FIG. 5 exemplifies a relation between the output waveforms of a rotor position detection circuit 43 and the rotation position signal of the motor 3.

FIG. 5 exemplifies a relation between the output waveforms of the rotor position detection circuit 43 and the rotation position signal of the motor 3. Since the motor 3 is a three-phase two-pole motor, the three rotation position detection elements 42 for the U-, V- and W-phases are provided with an interval of 60 degrees. Rectangular waveforms 61 to 63 are obtained by subjecting the output signals of the rotation position detection elements 42 to the analog-to-digital (A/D) conversion processing. Each of the rectangular waveforms is changed between a low level and a high level alternately at every 90-degrees rotation of the rotor 3*b*. A rectangular waveform 64 is a narrow pulse generated at every 30-degrees rotation of the rotor 3*b* in response to the rising edge or the falling edge of the rectangular waveforms 61 to 63 for the U-, V- and W-phases. This rectangular waveform 64 is used as the position detection pulse, and the twelve position detection pulses appear during 360-degrees rotation of the rotor 3*b*. In FIG. 5, the rectangular waveform 64 becomes the high level at every 360-degrees rotation of the rotor 3*b* from the start point (rotation angle=0, the position signal "12"), and the twelfth rectangular pulse appears when the rotor 3*b* rotates by 360 degrees with respect to the stator 3*a*.

In the oil pulse unit 4 according to the embodiment, the input portion (liner plate 23) is coupled to the rotation shaft of the motor 3. Thus, the liner 21 is synchronizedly rotates with the rotor 3*b* to have the same rotation angle therewith. The rotation of the liner 21 is not completely synchronized with the rotation of the main shaft 24 as shown in FIG. 3. However, when the main shaft 24 rotates by a given angle in the striking operation, the liner 21 (the rotor 3*b*) will rotate by "360 degrees+the given angle" until reaching the next striking position.

Figure 6:
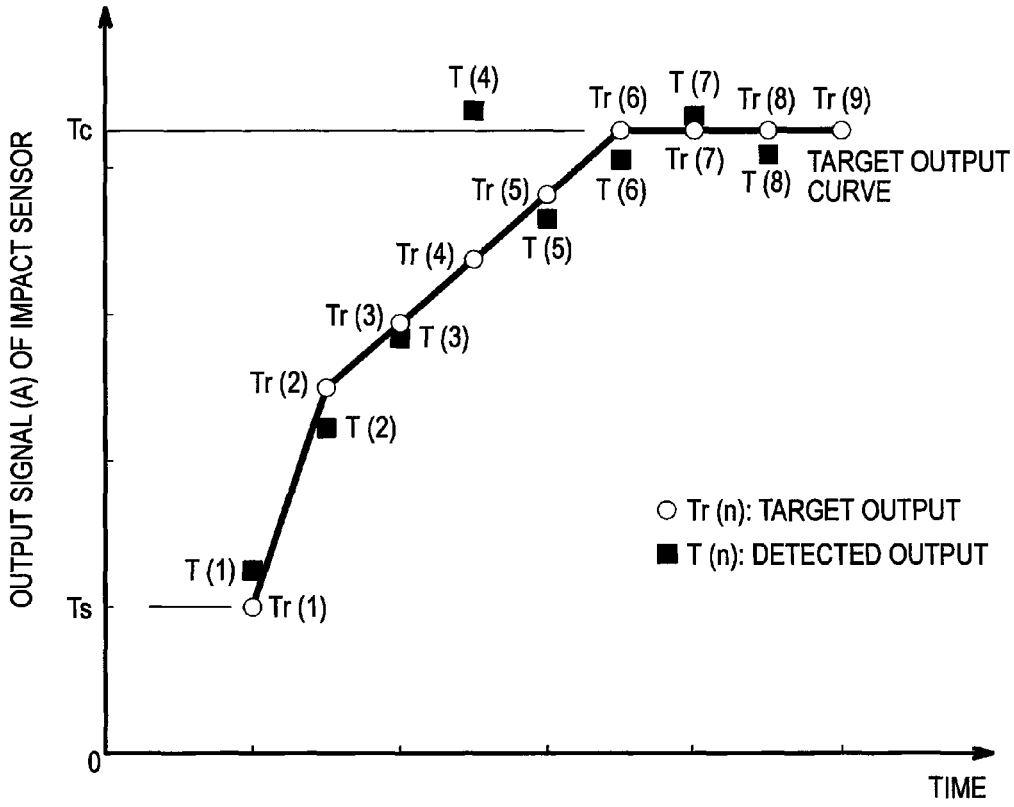
FIG. 6 exemplifies the target output and the actual output of an impact sensor 12 until the actual output reaches the final target output after the oil pulse unit 4 starts the striking operation.

FIG. 6 exemplifies the target output and the actual output of the impact sensor 12 until the actual output reaches the final target output after the oil pulse unit 4 starts the striking operation. The striking impact corresponds to the output value of the impact sensor 12. In the figure, the number of times of the striking operation is represented with the numerals in parenthesis. In FIG. 6, the ordinate represents the output signal (A/m2 or volt) of the impact sensor 12 and the abscissa represents the time (msec). When performing the fastening operation by the impact driver 1, the liner 21 and the main shaft 24 almost synchronizedly rotate until the seat surface of the fastening-subject bolt is seated, and the main shaft 24 is almost stopped while only the liner 21 rotates when a load is applied to the tip tool. Then, the fastening force is intermittently transmitted to the main shaft by the oil pulse unit 4, thereby performing the striking operation.

In the striking operation, the rotation of the motor 3 is controlled so that the output of the impact sensor 12 becomes the target output. For example, when the rotation of the motor 3 is controlled so that the target output Tr(1) of the first striking becomes equal to a start output Ts, the detected output is T(1). Next, the second striking is performed with the next target output Tr(2) calculated based on the output T(1). In the similar manner, the third and fourth striking operations are performed sequentially while gradually increasing the target output Tr(n), and the detected outputs are T(3) and T(4). Usually, when there is no failure or no quality variance etc. in the fastening material, such as the bolt or the nut, the detected output T(n) almost coincides with the target output Tr(n) (n=1, 2, . . . , m).

However, sometimes, the striking force may become large due to any reason. In FIG. 6, the fourth striking force becomes large so that the fourth output T(4) exceeds a cut output Tc. For example, when a large reaction force is received from the tip tool, even if a striking energy is not so large, the peak output becomes large while the striking period becomes short. In the impact driver having no rotation angle sensor (as in the related art), when the detected output T(4) exceeds the cut output Tc, the motor 3 will stop the rotation since it is determined that the fastening operation is completed. In the impact driver having an angular sensor at the main shaft 24 (as in the related art), when the detected output T(4) exceeds the cut output Tc, the striking operation can be continued without stopping the motor 3 by determining whether the normal fastening operation is completed based on whether the main shaft rotates more than a predetermined angle at the striking operation. However, when the angular sensor is not provided at the main shaft 24, the rotation angle in the striking operation can not be directly obtained to determine whether the fastening operation is completed.

Figure 7:
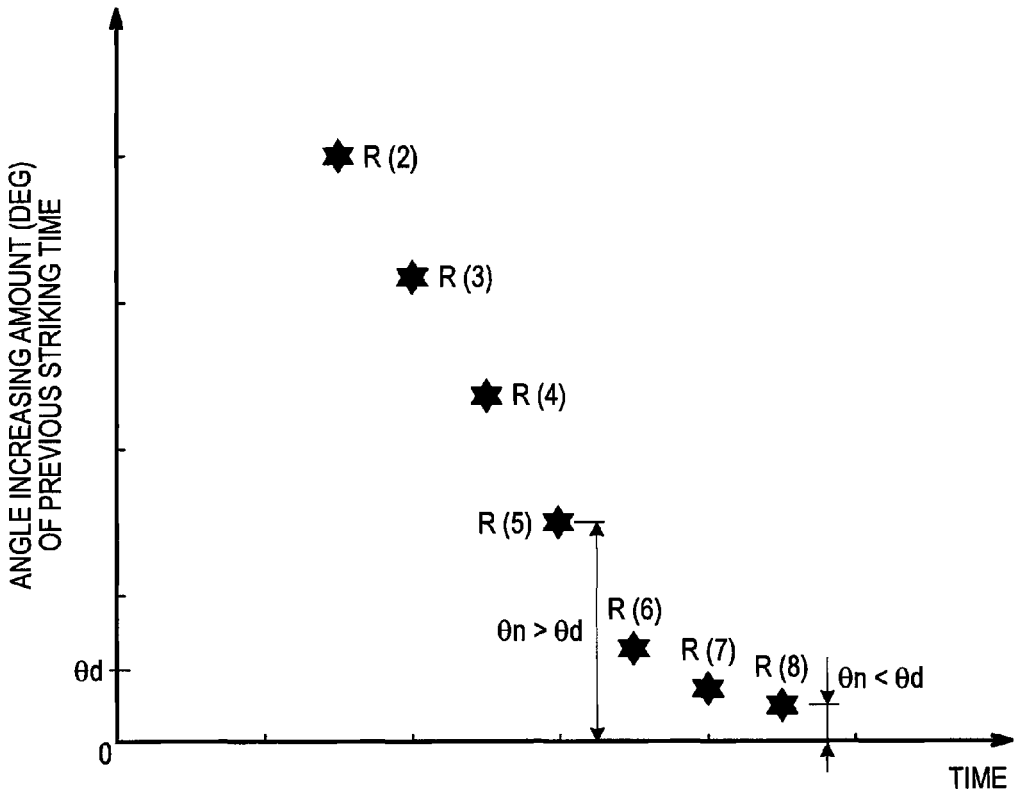
FIG. 7 exemplifies an increasing amount of a fastening angle from the previous striking to the current striking performed by the oil pulse unit 4.

Thus, the impact driver 1 according to the embodiment is configured to not immediately stop the motor 3 even if the output T(4) exceeds the cut output Tc and to perform an additional striking (called a "confirmation striking" in this specification) for the confirmation. In the confirmation striking, in the case of FIG. 6, the target output Tr(5) is set based on the previous target output Tr(4), not the previous output T(4). As a result, the target output Tr(5) is an output value almost between Tr(4) and Tr(6) and does not exceed the cut output Tc. FIG. 7 exemplifies an angle increasing amount R(n) of the main shaft 24 (tip tool) at the previous striking operation by the oil pulse unit 4. The angle increasing amount R(n) in FIG. 7 is presented correspondingly with the (n-th) striking timing in FIG. 6. As described above, the liner 21 (the rotor 3*b*) will rotate "360 degrees+the actual rotation angle of the main shaft 24" between the two striking operations. In view of that, the angle increasing amount R(n) can be obtained by using the rotation position detection elements 42 provided in the motor 3, without providing the angular sensor at the main shaft 24. For example, when it is rotated by "360 degrees+R(5) degrees" between the fourth striking and the fifth stinking, the main shaft 24 is rotated by R(5) degrees by the previous striking (fourth striking). As seen from FIG. 7, by performing the confirmation striking (fifth striking corresponding to T(5) in FIG. 6), it can be determined that the main shaft 24 had been rotated by a threshold value θd or more at the previous striking (fourth striking corresponding to T(4) in FIG. 6). Thus, according to the confirmation striking, it can be determined that the output T(4) exceeding the cut output Tc had appeared not due to the completion of the fastening operation but due to any other reason.

Since it is determined at the fifth striking operation that the output T(4) exceeding the cut output Tc had appeared not due to the completion of the fastening operation, the fastening operation can be continued, and the sixth and seventh striking operations can be continuously performed as shown in FIG. 6. At the seventh striking operation, although the output T(7) exceeds the cut output Tc, the motor 3 is not stopped immediately but the striking (eighth striking) for the confirmation is performed. And, it can be confirmed that the main shaft 24 rotates only by R(8) degrees at the previous striking (seventh striking) by performing the eighth striking. That is, it can be confirmed that the rotation angle of the main shaft 24 is smaller than the threshold value θd representing the completion of the striking operation at the previous striking, the motor 3 is stopped when the eighth striking is completed.

Figure 8:
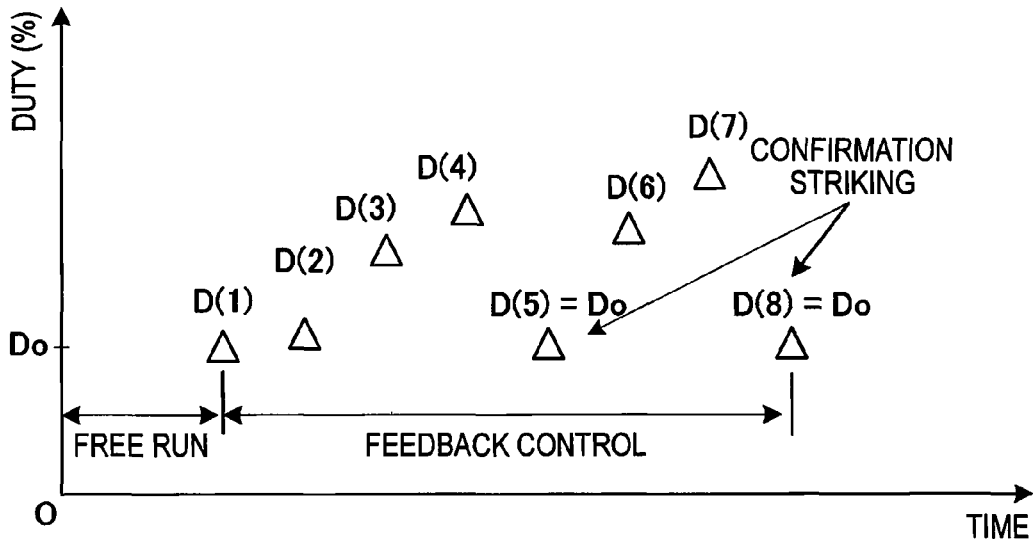
FIG. 8 exemplifies the duty ratio of a PWM signal supplied to an inverter circuit 47 at each striking operation shown in FIGS. 6 and 7.

FIG. 8 exemplifies the duty ratio of the PWM signal supplied to the inverter circuit 47 at each striking operation shown in FIGS. 6 and 7. The rotation control of the motor 3 is performed with a predetermined duty ratio D0 until the first striking is performed (free run), and the rotation control of the motor is performed with duty ratios determined by the following expression after the first striking is performed, that is, the feedback control is performed.

$$D(n)=D(n-1)+G1\times(Tr(n-1)-T(n-1))$$

where n=2 to m, G1: gain constant

According to this expression, the duty ratios are set to satisfy the relation of D(4)>D(3)>D(2) and D(7)>D(6) in order to gradually increase the striking force as the striking number of times increases. On the other hand, since each of the fifth and eighth strikings is the confirmation striking for confirming whether or not the fastening operation is completed, each of the fifth and eighth strikings is performed with the duty ratio (for example, the duty ratio D0) sufficiently smaller than the duty ratio of the previous striking.

Figure 9:
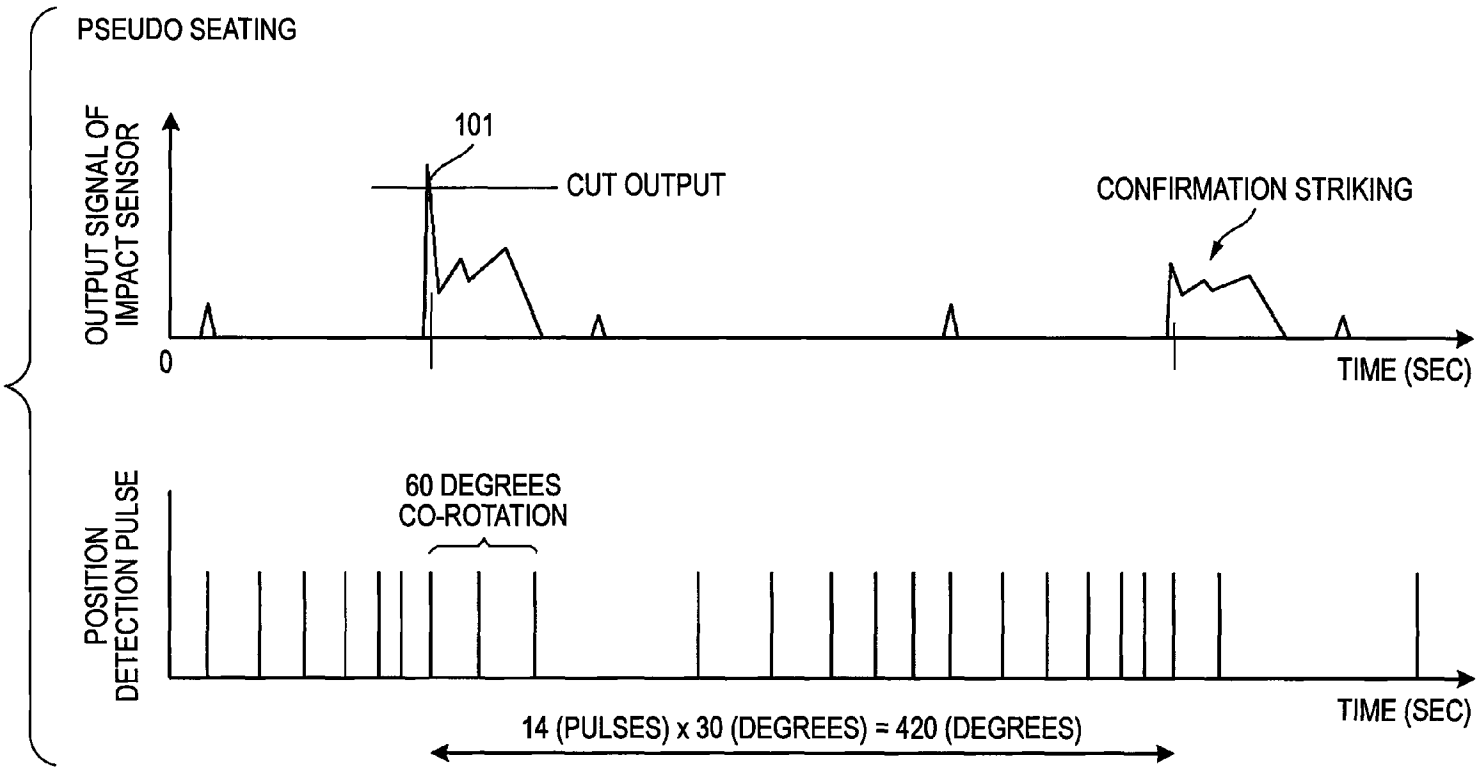
FIG. 9 exemplifies a relation between a peak output and position detection pulses in a pseudo seating state like the fourth striking shown in FIG. 6.

FIG. 9 exemplifies a relation between the peak output and the position detection pulses in a pseudo seating state like the fourth striking shown in FIG. 6. In the fourth striking, a peak output 101 exceeds the cut output Tc. However, in this case, the liner 21 of the oil pulse unit 4 rotates by a large angle (60 degrees, for example) so that the two or three position detection pulses appear until the peak output 101 reduces to 0. As a result, since the fourteen position detection pulses appear until the next confirmation striking, it is confirmed that the liner 21 rotates by 420 degrees between the fourth striking and the fifth striking. Since 360 degrees corresponds to one revolution, it can be calculated that the rotation angle of the main shaft 24 rotated at the fourth striking operation is 420-360=60 degrees. Normally, the liner 21 rotates together with the main shaft 24 at the striking operation (this phenomenon is called "co-rotation"). Since the 60-degrees co-rotation appears in the fourth striking, it can be determined that the state after the fourth striking is not the normal state (a state where the fastening operation can be performed scarcely) at the time of the completion of the fastening operation. Since the position detection pulse appears at every 30 degrees, the co-rotation may be detected with an angular error of less than ±30 degrees. Such the degree of error is sufficient for determining whether or not the fastening operation is completed.

Figure 10:
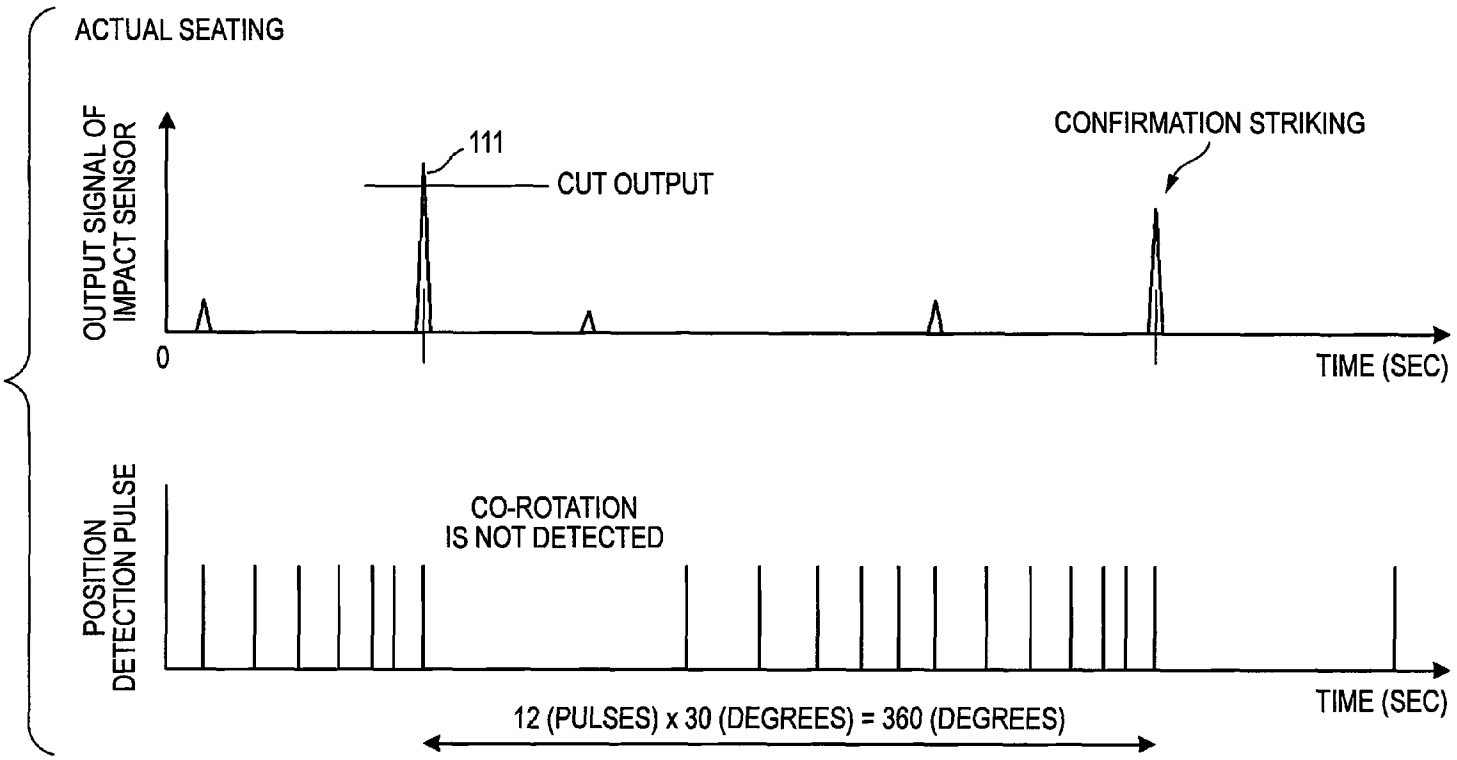
FIG. 10 exemplifies a relation between the peak output and the position detection pulses in an actual seating state like the seventh striking shown in FIG. 6.

FIG. 10 exemplifies a relation between the peak output and the position detection pulses in an actual seating state like the seventh striking shown in FIG. 6. In the case of the seventh striking, a peak output 111 exceeding the cut output Tc is generated. In this case, since the co-rotation of the liner 21 of the oil pulse unit 4 occurs scarcely, the position detection pulse does not appear until the peak output 111 reduces to 0. Then, since the 12 position detection pulses appear until the next confirmation striking, it can be confirmed that the rotation angle of the co-rotation at the seventh striking operation is almost 0. Thus, it can be confirmed that the state after the seventh striking is the state where the fastening operation of a bolt is completed and a further fastening operation can not be performed.

Figure 11:
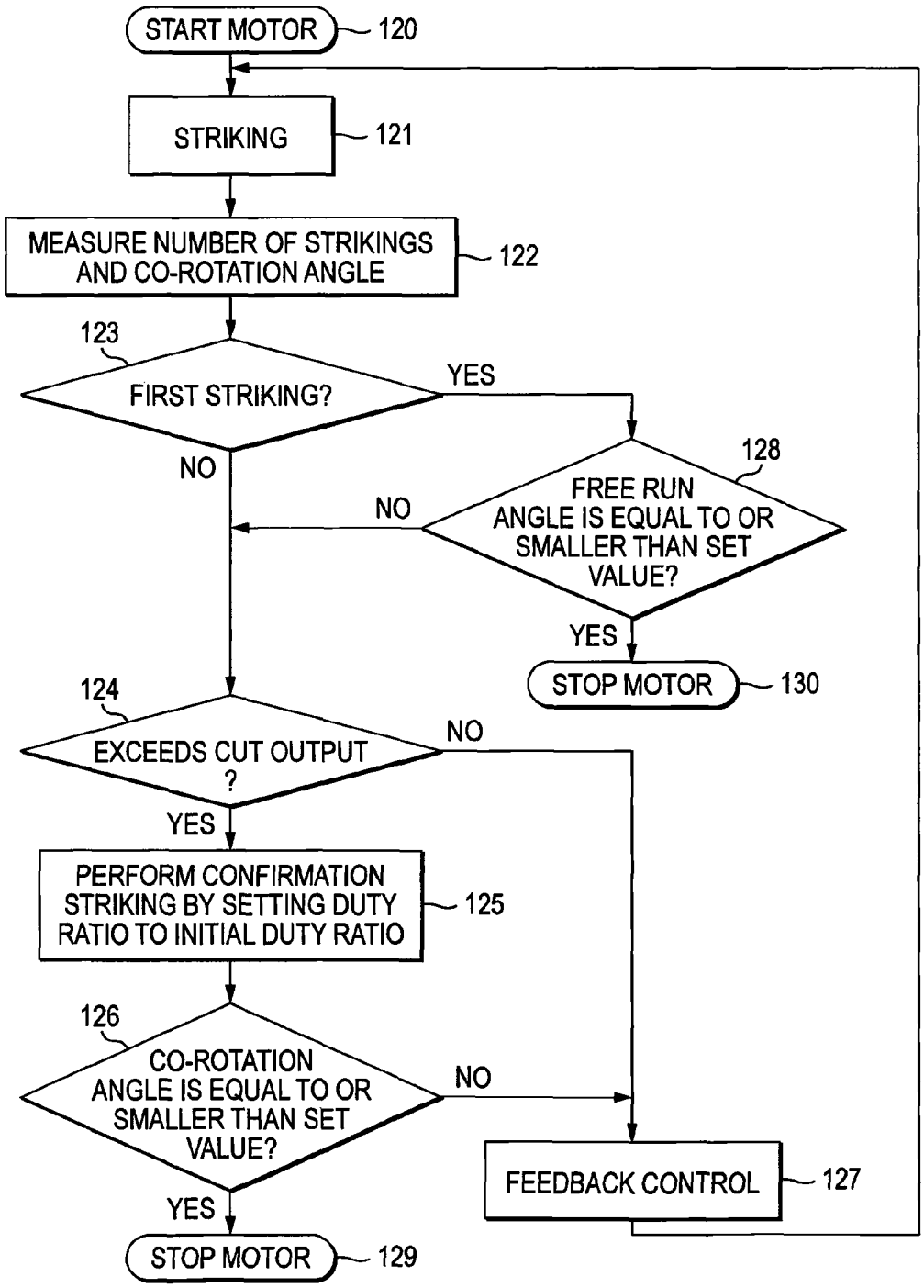
FIG. 11 exemplifies a control procedure of a striking operation in a rotary striking tool according to the embodiment.

Next, the procedure for confirming the fastening completion according to the embodiment will be explained with reference to a flowchart of FIG. 11. First, the motor 3 is started when the user pulls the trigger switch 8 (step 120). Although the rotation speed of the motor 3 changes in accordance with the pulling amount of the trigger switch 8, the liner 21 of the oil pulse unit 4 rotates almost synchronizedly with the main shaft 24 without causing any striking until a bolt is seated. When the bolt is seated and a reaction force applied from the tip tool becomes large, the main shaft 24 of the oil pulse unit 4 stops the rotation and only the liner 21 continues the rotation. When the liner 21 reaches the striking position explained in FIG. 3, a striking force due to the impact pulse is generated at the main shaft 24 to perform the first striking (step 121).

Next, the calculation part 41 (control unit) counts the number of the striking performed in step 121 and measures the co-rotation angle according to the method explained in FIGS. 9 and 10 (step 122). In the first striking, since there is no previous striking, the number of the position detection pulses appeared from the start of the motor 3 to the first striking is counted. Next, the calculation part 41 determines whether or not this striking is the first striking. The process proceeds to step 128 when this striking is the first striking, while the process proceeds to step 124 when this striking is the second or succeeding striking. In the first striking, a free run angle is obtained based on the number of the position detection pulses appeared from the start of the motor 3 to the first striking, and it is determined whether or not the obtained angle is equal to or smaller than a set angle for determining a double fastening. The double fastening is to perform a fastening again by pulling the trigger switch 8 by abutting the tip tool against the fastening subject such as a bolt. In this case, the striking operation is performed immediately at the next striking position during the rotation of the oil pulse unit 4. Thus, it is determined that the double fastening is performed when the striking operation is started at the rotation angle from the start of the motor 3 which is equal to or smaller than the set angle, whereby the calculation part 41 stops the rotation of the motor 3 to complete the processing (step 130). When it is determined that the free run angle is larger than the set angle in step 128, the processing proceeds to step 124.

It is determined in step 124 whether or not the peak output exceeds the cut output Tc. When the peak output does not exceed the cut output, the feedback control of the motor 3 is performed by using the detected output value (step 127) and the process returns to step 121. In the feedback control, the duty ratio D(n) for the feedback control is calculated from the detected output value. Next, when it is determined that the peak output exceeds the cut output in step 124, the duty ratio is set to the initial duty ratio D0 to thereby perform the confirmation striking (step 125). When the confirmation striking is performed, it is determined whether or not the rotation angle (co-rotation angle) until this striking is equal to or smaller than the set angle (step 126). When it is determined that the rotation angle is larger than the set angle, the process proceeds to step 127 since this state is the pseudo seating state explained in FIG. 9. In contrast, when it is determined that the rotation angle is equal to or smaller than the set angle in step 126, since it can be confirmed that this state is the actual seating state explained in FIG. 10, the calculation part 41 stops the rotation of the motor (step 129).

As explained above, according to the embodiment, even if a striking force generated at the output shaft exceeds the predetermined fastening force (cut output), the additional striking with a small striking force is performed as the confirmation striking to detect the rotation angle of the output shaft until the next striking is detected, whereby whether or not the fastening operation is performed correctly can be surely confirmed.

Although the above embodiment is exemplified, the invention is not limited thereto, and various modifications may be made within the scope of the invention. For example, although the oil pulse unit is exemplified as the impact unit, the invention is not limited thereto, and the invention may be applied in the similar manner not only to the rotary striking tool using the oil pulse unit but also to the rotary striking tool using an impact mechanism having a mechanical hummer and an anvil. Further, although the brushless DC motor is exemplified as the driving source of the impact mechanism, the invention may be applied in the similar manner to the rotary striking tool using a brush DC motor.

Further, the invention may be applied in the similar manner to the rotary striking tool using an air motor as the driving source. When the driving source having no detection mechanism for the motor rotation angle, such as the brush DC motor or the air motor, is used, a sensor for detecting the motor rotation angle or a sensor for detecting the rotation angle of the output shaft to which the tip tool is fixed may be used.

What is claimed is:

1. A rotary striking tool, comprising:

a motor;

an impact unit having a driving part and an output part, the driving part of the impact unit being driven by the motor;

an output shaft that is coupled to the output part of the impact unit such that a tip tool can be attached to the output shaft;

an impact detection unit that detects an impact generated at the impact, unit; and a control unit configured to control the motor such that a force of a striking by the impact unit is smaller than a force of a previous striking by the impact unit at a predetermined timing.

2. The rotary striking tool of claim 1, wherein the control unit is configured to control the motor such that the force of the striking by the impact unit is smaller than the force of the previous striking by the impact unit when the impact detected by the impact detection unit reaches a prescribed value.

3. A rotary striking tool comprising:

a brushless motor including a stator including windings and a rotor including a permanent magnet and configured to rotate within the stator;

an impact unit having a driving part and an output part, the driving part of the impact unit being driven by the brushless motor;

a plurality of rotation position detection elements configured to detect a rotation position, of the rotor disposed, along a circumferential direction with predetermined intervals therebetween; and a control unit configured to control the brushless motor based on a signal from the rotation position detection element, wherein the control unit detects a striking by the impact unit based on the signal from the rotation position detection element.

4. The rotary striking tool of claim 3, further comprising an output shaft that is coupled to the output part of the impact unit such that a, tip tool can be attached to the output shaft, wherein the plurality of rotation position detection elements output pulses at a predetermined, cycle, when a rotation of the output shall substantially synchronizes with a. rotation of the rotor, and wherein the control unit detects the striking by the impact unit when the pulses are not output at the predetermined cycle.

5. The rotary striking tool of claim 4, wherein a predetermined number of pulses are output between a previous striking and a next striking, and wherein the control unit determines that the previous striking is abnormal when a number of pulses output between the previous striking and the next striking is larger than a predetermined number.

6. A method of operating a rotary striking tool including an impact unit having a driving part and an output part, the driving part of the impact unit being driven by a motor; an output shaft that is coupled to the output part of the impact unit such that a tip tool can be attached to the output shaft; and an impact detection unit that detects an impact generated at the impact unit, the method comprising steps of:

rotating the motor such that a force of a confirmation striking is smaller than a force of a previous striking performed prior to the confirmation striking;

controlling the impact unit to perform a confirmation striking when the impact detected by the impact detection unit reaches a prescribed value;

detecting a rotation angle of the output shaft at the confirmation striking;

determining whether a fastening operation is completed when the detected rotation angle is equal to or smaller than a predetermined angle; and continuing the fastening operation when the detected rotation angle is larger than the predetermined angle.

7. The method of claim 6, further comprising the step of:

calculating the rotation angle based on outputs of the rotation position detection elements, wherein:

the motor is a brushless DC motor, and rotation position detection elements are provided at the brushless DC motor.

8. The method of claim 7, further comprising the step of:

calculating the rotation angle based on variation in the outputs of the rotation position detection elements during a period from a previous striking to a next striking.

9. The method of claim 8, wherein:

the brushless DC motor includes a rotor having plural permanent magnets of pairs of N and S poles, and the position detection elements are hall elements or hall ICs which are provided at a predetermined interval so as to face the permanent magnets.

10. The method of claim 8, further comprising the step of:

performing the confirmation striking in a state where a duty ratio of a signal supplied to an inverter circuit for supplying a driving current to the brushless DC motor is reduced.

* * * * *